United States Patent [19]

Obermuller

[11] Patent Number: 4,850,857

[45] Date of Patent: Jul. 25, 1989

[54] APPARATUS FOR THE COMBUSTION OF OXIDIZABLE SUBSTANCES SUSPENDED IN A CARRIER GAS

[75] Inventor: Herbert J. Obermuller, Linsengericht-Grossenhausen, Fed. Rep. of Germany

[73] Assignee: Katec Betz GmbH & Co., Hasselroth, Fed. Rep. of Germany

[21] Appl. No.: 948,345

[22] PCT Filed: Aug. 27, 1986

[86] PCT No.: PCT/EP86/00501

§ 371 Date: Dec. 2, 1986

§ 102(e) Date: Dec. 2, 1986

[87] PCT Pub. No.: WO87/01434

PCT Pub. Date: Mar. 12, 1987

[30] Foreign Application Priority Data

Sep. 10, 1985 [DE] Fed. Rep. of Germany ..... 3532232

[51] Int. Cl.[4] ..... F23D 11/44

[52] U.S. Cl. ..... 431/242; 431/215; 431/247; 431/248; 431/243; 431/5; 431/11; 422/203; 422/204

[58] Field of Search ..... 431/5, 11, 247, 248, 431/278, 285, 284, 200, 242, 239, 215, 243; 422/203, 204; 110/254, 203, 210, 211, 212, 213, 214; 60/39.12; 432/72

[56] References Cited

U.S. PATENT DOCUMENTS

| | | | |
|---|---|---|---|
| 1,881,206 | 10/1932 | Magis et al. | 122/235 F |
| 3,549,333 | 12/1970 | Tabak | 431/5 X |
| 3,806,322 | 4/1974 | Tabak | 431/5 X |
| 3,838,975 | 10/1974 | Tabak | 431/5 X |
| 3,898,040 | 8/1975 | Tabak | 431/5 X |
| 4,364,724 | 12/1982 | Alpkvist | 431/247 X |
| 4,365,951 | 12/1982 | Alpkvist | 431/247 X |

FOREIGN PATENT DOCUMENTS

| | | | |
|---|---|---|---|
| 0040690 | 12/1981 | European Pat. Off. . | |
| 2352204 | 4/1975 | Fed. Rep. of Germany | 431/5 |
| 3043286 | 10/1981 | Fed. Rep. of Germany | 110/213 |
| 3107664 | 9/1982 | Fed. Rep. of Germany . | |
| 3332070 | 3/1985 | Fed. Rep. of Germany | 110/214 |
| 638298 | 4/1948 | United Kingdom . | |
| 1273200 | 3/1972 | United Kingdom . | |

*Primary Examiner*—Albert J. Makay
*Assistant Examiner*—Carl D. Price
*Attorney, Agent, or Firm*—Dennison, Meserole, Pollack & Scheiner

[57] ABSTRACT

An appliance for the combustion of oxidizable substances in a carrier gas is described, in which the carrier gas is fed through heat exchanger tubes having inlet ends which are bent outwardly adjacent an outlet for gas from which oxidizable substances have been removed by combustion. Prior to entering the tubes the carrier gas passes an annular chamber in which it becomes pre-heated and condensates are evaporated.

6 Claims, 1 Drawing Sheet

APPARATUS FOR THE COMBUSTION OF OXIDIZABLE SUBSTANCES SUSPENDED IN A CARRIER GAS

BACKGROUND OF THE INVENTION

1. Field of the Invention

This invention relates to an apparatus for the combustion of oxidizable substances, suspended in a carrier gas, and comprises of a gas inlet and gas outlet, a burner to which a high velocity mixing pipe is connected, a primary combustion chamber, a heat exchanger consisting of heat exchange tubes placed around the high velocity mixing chamber which transports the unprocessed gas in counter-flow to the already incinerated gas. These tubes are bent at one end.

2. Description of The Prior Art

An appropriate device of this type is described in German DE No. 30 43 286, Oct. 22, 1981 and corresponding EP No. 0 040 690 Dec. 2, 1981. Here the heat exchange tubes are bent inwardly on the high-temperature-side of the apparatus, i.e. curved inwardly in the vicinity of the burner and connected into a drum which encompasses the burner concentrically. Admittedly, this design offers the advantage that, different expansions of individual tubes, caused by temperature, do not lead to damage during process dependent applications, such as cracking.

This, however requires a considerable manufacturing effort in order to weld the inwardly bent tubes to the drum, due to the fact that, the space between the tubes is small. The drum as such cannot contribute to the compensating of tube expansions occuring from temperature differentials, because its relatively large wall thickness is necessary to prevent contraction and distortion during welding, which would in turn subject the tube bends to undue stress and strain.

Furthermore, the heat exchange tubes do not effectively transfer heat over their entire length, because the hot exhaust gas does not impinge directly on the curved ends, but is deflected and diverted away, so that it misses these parts of the tubes.

Moreover, the occurrence of scale formation in the vicinity of the tube bends is inavoidable, because these bends are located within the hottest part of the appliance. Scale build-up however can cause increased erosion of the tube walls when the tubes are subjected to large rates of change of expansion in this region. Such rates of change of expansion are more often than not characteristic of a particular process.

SUMMARY OF THE INVENTION

The object of this invention is to improve upon the device as previously described in such a fashion that, the heat exchanger and its components can be protected against varying expansions and surface damage due to temperature, utilizing simple design methods.

In accordance with the objects of this invention the problem is addressed by allowing the cold ends of the heat exchange tubes to curve outwardly. The immediated advantage is that the tube ends are connected to an circumferential area substantially larger than that required for inwardly curved tubes, thereby making welding easier and even making automatic welding possible.

As these welded ends may be spaced much further apart in such fashion that the shell housing the tube ends need not be an extra component such as a drum as prescribed by state of the art, what is more, the inside wall of the outer annular chamber, through which the combustible laden carrier gas is fed from the inlet nozzle to the heat exchanger tubes, is used as a wall to which the tubes are welded in a preferred embodiment of the invention.

As there is no danger of contraction and distortion during welding of the tubes due to the wider spacing, a thinner shell wall may also be chosen, and this consequently increases the overall flexibility of the region of thermal compensation.

As the available space for the outwardly curved heat exchange tube ends may be made as large as necessary, another resulting advantage is the number of consecutive tube rows may be increased with increasing number of tubes at the other tube rows in comparison to the arrangement in accordance with EPO No. 040 690.

In combination with this the flow of the gas around the tubes becomes increasingly more turbulent.

This ultimately enables the number of cross-flow heat exchange passes to be reduced for the same effectiveness.

This simplifies the design and reduces it's cost.

A further advantage is the possible reduction in the tube wall thickness, because no additional allowance for loss of material through descaling is required. Through the omission of this extra wall-thickness allowance, the total flexibility of the tube bend is considerably increased. Costs can be decreased, too. Moreover the use of low-alloy tubing in the region of bending is also possible.

It is possible to use the device for special critical applications in keeping with the invention whereby high gas inlet temperatures in conjunction with preheating to a very high temperature, in the presence of large amounts of combustible substances produce considerable partial precombustion of the combustible substances. This can cause very high temperatures within the high-temperature zone of the heat exchange tubes, which are then balanced by the outwardly curved compensating tube bends.

Therefore, according to the invention, pre-combustion—always associated with extreme preheating temperatures—can normally not lead to serious damage. This means that the high temperature section of the heat exchanger functions to an extent as a "pre-combustion chamber", and that it should be capable of fulfilling this task.

It may also be seen as a characteristic of this invention that the high temperature portion of the heat exchanger functions to a certain extent as a pre-combustion chamber stage, especially in operation conditions with small volumetric flows in connection with high concentrations of substances.

Danger of material fatique and failure has been eliminated by placing the tube bends at the cold end of the heat exchanger, where the allowable stress levels are much higher than those at 700 degrees C. (approx. 1290 degrees F.).

Advantageous is also the safe partial pre-oxidation of combustible substances in the tubes of the heat exchanger.

A further advantage of arranging the curved tube ends at the low-temperature side of the apparatus may be seen in that the abrasion of the tube bends is virtually eliminated due to the low flow rate of the gas medium at the entrance of the tubes.

In the region of transitional flow, i.e. between fully laminar and fully turbulent flow, individual tubes or groups of tubes neighbouring each other are subjected to more or less laminar or turbulent flow, on the inside and/or the outside of the tubes.

This undesirable feature is a drawback, when the incineration unit has a large flow range. The large expansion differentials demand especially a great amount of elasticity of each individual tube.

The gravity of this problem is made even more worse by the possible sudden change between laminar and turbulent flow or vice versa. This means, expansion differentials may occur at a high rate of change, and that the elements of thermal compensation must be made to accomodate these high rates of change of thermal growth. A bend with scale is far less suited to fit this demand, because it would tend to lose scale.

In compliance with the invention the gas flows around the heat exchanger tubes and over the bends. This means the tube bends operate at a temperature in the region of 250 degrees C. to 300 degrees C. (480 degrees F. to 570 degrees F.), which more or less eliminates the danger to damage to the tubes due to big and sudden changes over all the tubes or between single tubes. As previously mentioned the build up of scale is also prevented in order to maintain the wall thickness at a constant level.

As a further embodiment of the invention, the cool gas carrying the oxidizable substances, is fed from an inlet nozzle to the curved ends of the heat exchanger tubes through an annular chamber lining the mainly cylindrical shell of the appliance, whereby the annulus may extend into the outlet opening. Both the heat exchanger shell and the outer shell of the annulus thus function to a greater or lesser extent as heat exchange surfaces.

This means that the incoming fluid is not only preheated, but also more importantly the suspended condensate in the gas would evaporate almost completely before entering the tubes. Here too, it is worth mentioning that the amount of tubular heat exchange surface becomes less due to the pre-heating effect in the annular chamber. This also lowers the costs.

As the cool gas carrying the oxidizable substances is fed to the heat exchanger tubes through the annular chamber lining the shell, no expensive external lagging is required, and with horizontal mounting of the device high heat resisting leg construction can be avoided.

In compliance with the invention, the annular chamber extends between carrier-gas inlet and outlet. As a principle of the invention the carrier-gas inlet together with the first annular chamber are situated in the vicinity of the burner, whereby the annular chamber encompasses the burner concentrically.

The structure of the present invention advantages worth special mention, for example the pre-heating of the gas, the condensate evaporation, the longitudinal thermal compensation, the safe pre-combustion, or the advantageous placing and fixing of the heat exchanger tubes.

BRIEF DESCRIPTION OF THE DRAWINGS

Further details and particulars of the invention are shown in FIG. 1, which comprises a schematic illustration, in vertical cross-section, of one embodiment of a combustion apparatus in accordance with the invention.

DESCRIPTION OF THE PREFERRED EMBODIMENT

Figure 1:
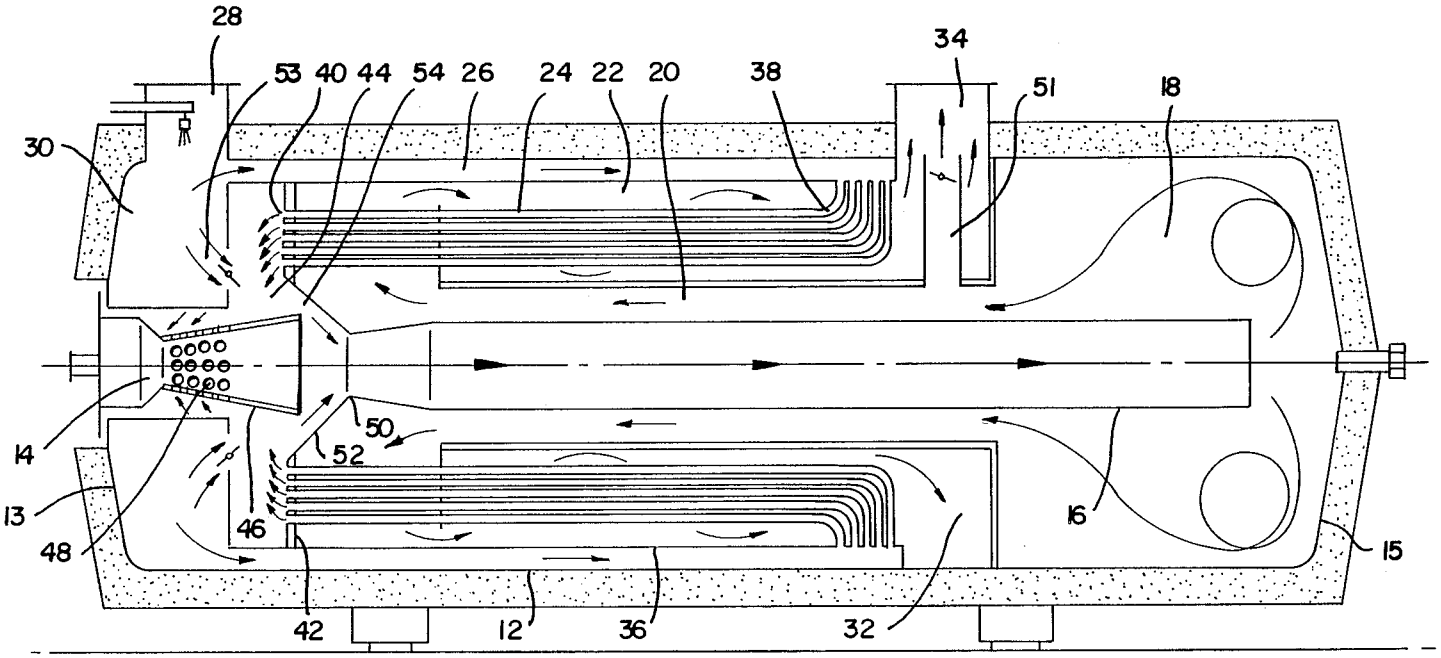

FIG. 1 depicts an applicance for the combustion of oxidizable substances suspended in a carrier-gas such as exhaust or waste gas. This may also be designated an afterburner appliance.

The appliance consists of a cylindrical external shell, see (12), terminating with two end-plates, see (13) and (15). In the region of the closed end (13), the burner (14), is concentrically positioned to the main axis of the shell (12). Down-stream of the burner a high velocity mixing pipe (16) may be seen followed by a primary combustion chamber (18) ended by a closed-end. It may be further noted that, it is not a necessary design criterium for the high velocity mixing pipe (16), to extend well into the primary burning chamber (18).

The high velocity mixing pipe (16) is surrounded concentrically by an internal annular chamber (20) which opens up into a chamber designated (22) in which heat exchange / precombustion tubes (24) are arranged concentrically relative to the longitudinal axis of the appliance and hence also to the high velocity mixing pipe (16).

The heat-exchange / pre-combustion tubes (24) terminate at the external annular chamber (26), the outer wall of which is the inner wall of the shell (12). The aforementioned annular chamber (26) which ecompasses the burner (14) begins with the inlet chamber (30). Chamber (30) opens up into the inlet nozzle (28).

Furthermore, an annular chamber (32) which opens out into outlet nozzle (34) is connected to chamber (22) on the opposite side of annular chamber (30).

The ends (38) of the heat exchange / pre-combustion tubes (24) in the vicinity of the opening (34) are bent radially outwards towards shell (12), so as to enter wall (36) of the outer annular chamber (26) almost perpendicularly. The other ends (40) of the heat exchange / pre-combustion tubes (24) open into a tube plate (42), which screens the pre-combustion chamber (44) surrounding the burner (14), from chamber (22).

The burner (14) has a diverging frusto-conical burner portion (46) opening towards the high velocity pipe 16 opening front section, which burner portion (46) has perforations, such as holes (48), in its circumferential area.

At the end facing the burner (14), the high velocity pipe (16) has the form of a venturi nozzle, see (50).

The space between a burner front section (46) and the venturi inlet cone (52) of the high velocity pipe forms an annular gap (54).

In order that combustibles, present in the carrier gas, may be incinerated in compliance with this invention, carrier gas is fed to the outer or external annular chamber (26) via the inlet (28) and the annular chamber (30) from whence the carrier gas is conducted into the heat exchange / pre-combustion tubes (24). The gas first flows through the region, where the tubes are curved outwardly. There the ends (38) of these tubes are welded into the inner wall (36), of the outer annular chamber (26).

It should be mentioned that even with a tightly packed heat exchanger tube bundle, the space between the tube ends (38) can be chosen relatively large, thus enabling their trouble free mounting and also the wall thickness (36) in this area to become thin. This again leads to higher flexibility and additional thermal compensation for longitudinal expansion changes of the tubes (24).

Then the gas, having passed the heat exchange tubes (24) ending in tube plate (42), enters the pre-combustion chamber (44). From here on the flow of gas is split into a main flow to the annular gap (54) and another flow through the burner perforations (48) leading into the flame, from where both streams re-unite again prior to them reaching the high velocity mixing pipe (16). Having passed through the high velocity mixing pipe (16) the gas then enters the primary combustion chamber (18), where a high degree of turbulence results.

On leaving this chamber the gas passes via chamber (20) towards the internal annular chamber (22), which contains the heat exchange / pre-combustion tubes (24), in order to flow in a cross-counter flow pattern around the entire length of the aforementioned tubes, whereby several changes of flow direction occur within chamber (22)—depicted by arrows in diagram, therewith achieving the required extent of heat exchange. From here the gas reaches the outlet opening (34) via the annular chamber (32).

By virtue of the fact that the inner wall (36) of the outer annular chamber (26) also serves as a heat exchange surface, along which the hot gases coming from the inner annular chamber (20) travel, heat is delivered to the gas which enters at the inlet nozzle (28) and then passes through the annulus towards the heat exchange / pre-heat tubes (24). This ensures that any condensate present is evaporated, thus preventing condensation in the tubes (24).

Due to the fact that a temperature ranging only between 250 degrees C. and 300 degrees C. (480 degrees F. to 570 degrees F.) exists in the region of the bent tube ends (38) of the tubes (24), this temperature in relationship to the stress levels in the tubes may be considered as low, so that danger of scale formation or loss of wall thickness is not present. Loss of wall thickness is hence eliminated, and danger of fatique, too, due to the high elasticity in the region of the curved tube ends (38) and the high stress allowance. These ends serve to compensate for differential longitudinal growth of the heat exchange / pre-heat tubes (24) due to changes in temperature and to different rates of flow. In addition to this, the low temperature of the gas at the curved tube ends (38) ensures a low flow rate which in turn prevents the tube bends from suffering abrasion of their inner wall providing the exhaused gas contains abrasive particles.

As the inlet-opening (28) and the adjoining annular chamber are arranged in the hot portion of the appliance, it is a simple matter to provide a "cold-by-pass" (53) between chambers (30) and pre-combustion chambers (44). This enables cold carrier gas laden with oxidizable components to be partially fed directly to the burner (14), and the high velocity mixing pipe (16).

As this area is situated closely to the heat radiating burner (14)/(48) and next to the pre-combustion chamber (44) - the temperature being between 600 degrees C. and 650 degrees C. (approx. 1100 degrees F. to 1200 degrees F.)—the risk of condensate formation is completely eliminated.

Besides the troublefree arrangement of a cold gas by-pass a further possibility exists in providing a hot gas by-pass (51) between the main-combustion chamber (18) and the outlet opening (34), or as the case may be the upper portion (32a) of annular chamber (32) to which the outlet opening joins.

Besides this the wall between chamber (18) and (32) requires sufficient heat insulation, but this may be achieved without extensive construction effort.

A further advantage of the appliance, see FIG. 1, in accordance with the invention is that no greater demands are made on the leg supporting the outer wall (12), in the vicinity of the outer annular chamber (26), because the said chamber forms a heat screen when the low-temperature gas passing this chamber absorbs heat through the inner separating wall (36).

Due to the fact that inlet (28) and outlet (34) can be placed apart from each other, the design also offers the possibility of a vertical arrangement of the appliance. This does not require complex or costly measures, as no external pipe-work is necessary for the device to function properly.

I claim:

1. An appliance for the combustion of oxidizable substances in a carrier gas, comprising an elongated housing having an outer wall (12) having a gas inlet (28) and a gas outlet (34) longitudinally remote from said inlet, a burner (14) having at least a portion projecting into said housing adjacent said gas inlet, a high velocity mixing chamber in said housing positioned generally coaxial with and in flow communciation with said portion of said burner projecting into said housing, said burner and said high velocity mixing chamber in flow communication with and opening into a combustion chamber in said housing, and a heat exchanger within said housing and having a plurality of tubes having inlet ends in flow communication with said gas inlet and outlet ends in flow communication with said high velocity mixing chamber and in indirect heat exchange relation to and radially arranged so as to encompass the high velocity mixing chamber, said tubes being positioned generally parallel to the axis of the high velocity mixing chamber by means for positioning said tubes, said tubes being adapted for internal flow of unprocessed oxidizable substancecontaining carrier gas introduced at said gas inlet and for external counter-flow around the tubes of gas received from said combustion chamber and from which oxidizable substances have been removed by combustion wherein said tubes terminate at one end in a bent portion, the bent end portions (38) of the heat exchanger tubes (24) being said inlet ends and being adjacent the gas outlet (34), the bent end portions (38) of said tubes being curved outwardly, and chamber means for establishing flow communication between the gas inlet and the bent end portions (38) of the tubes (24) thereby effecting counter flow of combustion gases with respect to the gas flow within the tubes.

2. An appliance in accordance with claim 1, wherein said chamber means for establishing flow communication between the gas inlet and the bent end portions (38) of the tubes (24) comprises an outer annular chamber (26) wherein the outer wall (12) comprises the outer wall of the elongated housing.

3. An appliance in accordance with claim 2, wherein the outer annular chamber (26) extends in flow communication with and from said gas inlet (28) and to a position adjacent said gas outlet (34), the outer annular chamber being sealed from flow communication with gas outlet (34).

4. An appliance in accordance with claim 2, wherein said outer annular chamber (26) includes an inner wall (36) which comprises a heat exchange surface for preheating the carrier gas flowing through outer annular chamber (26).

5. An appliance in accordance with claim 1, wherein the carrier gas inlet (28) includes an annular chamber (30) in the region of the burner (14), the annular chamber (30) being interposed in flow communication with the gas inlet (28) and the outer annular chamber (26).

6. An appliance in accordance with claim 5, wherein the annular chamber (30) is outwardly concentric of the burner (14).

* * * * *